US008710428B1

(12) United States Patent
Loftus et al.

(10) Patent No.: US 8,710,428 B1
(45) Date of Patent: Apr. 29, 2014

(54) PERMANENT MAGNET AXIAL FIELD ZEEMAN SLOWER

(75) Inventors: Thomas H. Loftus, Los Gatos, CA (US); Artyom Vitouchkine, Redwood City, CA (US); Leo Hollberg, Portola Valley, CA (US)

(73) Assignee: AOSense, Inc., Sunnyvale, CA (US)

( * ) Notice: Subject to any disclaimer, the term of this patent is extended or adjusted under 35 U.S.C. 154(b) by 55 days.

(21) Appl. No.: 13/402,792

(22) Filed: Feb. 22, 2012

(51) Int. Cl.
*H05H 3/04* (2006.01)

(52) U.S. Cl.
USPC ..... 250/251; 335/306

(58) Field of Classification Search
USPC ..... 250/251; 335/209, 210, 296, 302, 306
See application file for complete search history.

(56) References Cited

U.S. PATENT DOCUMENTS

| | | | | |
|---|---|---|---|---|
| 3,919,678 | A * | 11/1975 | Penfold | 335/296 |
| 4,701,737 | A * | 10/1987 | Leupold | 335/301 |
| 5,014,032 | A * | 5/1991 | Aubert | 335/306 |
| 5,098,619 | A * | 3/1992 | Facaros | 264/428 |
| 6,476,383 | B1 * | 11/2002 | Esslinger et al. | 250/251 |
| 2002/0117612 | A1 * | 8/2002 | Kumagai et al. | 250/251 |
| 2009/0128272 | A1 * | 5/2009 | Hills | 335/306 |
| 2010/0012826 | A1 * | 1/2010 | Miteva et al. | 250/251 |
| 2011/0148297 | A1 * | 6/2011 | Yasuda et al. | 315/5.35 |

OTHER PUBLICATIONS

Lison et al, "High-Brilliance Zeeman-Slowed Cesium Atomic Beam", Physical Review A, vol. 61, 013405, 1999.*
Oates et al, "A Diode-Laser Optical Frequency Standard Based on Laser-Cooled Ca Atoms; Sub-Kilohertz Spectroscopy by Optical Shelving Detection", European Physical Journal D, 449-460 (1999).*
D'Amore et al, "Feasibility of New Nanolayered Transparent Thin Films for Active Shielding of Low Frequency Magnetic Field", International Symposium on Electromagnetic Compatibility EMC 2005, vol. 3, p. 900-905, 2005.*
Ramirez-Serrano et al, "Multistage Two-Dimensional Magneto-Optical Trap as a Compact Cold Atom Beam Source", Optics Letters, vol. 31 No. 6, Mar. 15, 2006.*
Kondo et al, "Influence of the Magnetic Field Gradient on the Extraction of Slow Sodium Atoms Outside the Solenoid in the Zeeman Slower", Jpn. J. Appl. Phys. vol. 36 (1997) p. 905-909.*
Cheiney, et al, "A Zeeman Slower Design With Permanent Magnets in a Halbach Configuration", Review of Scientific Instruments 82, 063115, 2011.*
Chieney et al, "A Zeeman Slower Design With Permanent Magnets in a Halbach Configuration", Review of Scientific Instruments 82, 063115, 2011.*
Kondo et al, "Influence of the Magnetic Field Gradient on the Extraction of Slow Sodium Atoms Outside the Solenoid in the Zeeman Slower", Jpn. J. Appl. Phys, vol. 36, (1997), pp. 905-909.*

* cited by examiner

*Primary Examiner* — Jack Berman
*Assistant Examiner* — David E Smith
(74) *Attorney, Agent, or Firm* — Van Pelt, Yi & James LLP

(57) ABSTRACT

An atomic slower comprises a bore and one or more tapered permanent magnets configured to produce an axial magnetic field along an axis of the bore.

37 Claims, 6 Drawing Sheets

PERMANENT MAGNET AXIAL FIELD ZEEMAN SLOWER

This invention was made with government support under contract #HR0011-11-C-0072 awarded by Darpa. The government has certain rights in the invention.

BACKGROUND OF THE INVENTION

Some scientific procedures utilize a thermal beam of atoms and sometimes it is advantageous to have a more slowly moving beam of atoms, and in some cases the atoms from the beam are captured, and in some cases the atoms in the beam are used for other applications (e.g., spectroscopy). A common method of generating a beam of atoms uses an evaporator with an outlet. In some cases, the outlet is a thin-walled pinhole, an array of tubes, one or several cylindrical channels, a slit or array of slits, a microchannel plate, or a combination of these items. Atoms are evaporated and exit the evaporator at high speed through the outlet. Atomic collectors typically require atoms to be at low speed in order to be captured, thus they must be slowed between the evaporator and the collector. Other applications for the beam also require low speeds. The Zeeman slower is a well-known method of slowing a beam of atoms, comprising a laser beam and a magnetic field. The laser beam shines into the beam of atoms opposite their direction of travel and is tuned to resonate with a quantum transition in the atoms. When a photon from the laser is absorbed, the atom loses momentum and slows down. When averaged over a large number of absorption-emission cycles, the process of absorbing and re-emitting photons causes a net slowing of the atoms. Due to the Doppler effect, the resonance frequency for a given atom as measured in the lab frame (i.e., the frame for the laser beam) depends on the velocity for the atom. If a fixed frequency laser is used for the cooling, then as the atoms slow down, the frequency difference between the laser and the atomic resonance increases, which causes the photon scattering rate to decrease. The acceleration experienced by the atom depends on this rate, so as the scattering rate decreases, the acceleration decreases. To avoid this problem, a magnetic field is used. The magnetic field counteracts the changing Doppler shift by modifying the resonance frequency of the atoms (e.g., the Zeeman effect). This approach allows the laser beam to continue slowing the atoms as they themselves slow down. For atomic transitions with linear Zeeman shifts the required magnetic field can be derived from a resonance condition: $\nu_0 \pm (\mu/h)B = \nu_L = u/\lambda$ where $\nu_0$ ($\nu_L$) is the atomic (laser) frequency, $\mu$ is the magnetic moment for the transition, B is the amplitude for the magnetic flux density, $\lambda$ is the wavelength for the atomic transition, and u is the instantaneous speed for the atom. Ideally, the field is axial (e.g., the field lines are collinear with the direction of travel for the atomic beam). Atoms with transitions that have different dependencies of Zeeman shifts could also be slowed by tailoring the magnetic field appropriately to maintain resonance as the atoms are slowed.

Typically the magnetic field is produced with electromagnets. Electromagnets allow for easy customization of the magnetic field to the desired shape. However, electromagnets take up a great deal of space and require power and cooling systems. Although electromagnets can be housed inside vacuum chambers, this approach is impractical for Zeeman slowers given the heat loads and vacuum outgassing generated by the requisite electromagnets. Hence the windings are usually housed outside the vacuum chamber where the atomic beam travels. This results in a large and power-hungry device, unsuitable for some applications.

BRIEF DESCRIPTION OF THE DRAWINGS

Various embodiments of the invention are disclosed in the following detailed description and the accompanying drawings.

DETAILED DESCRIPTION

Figure 1:
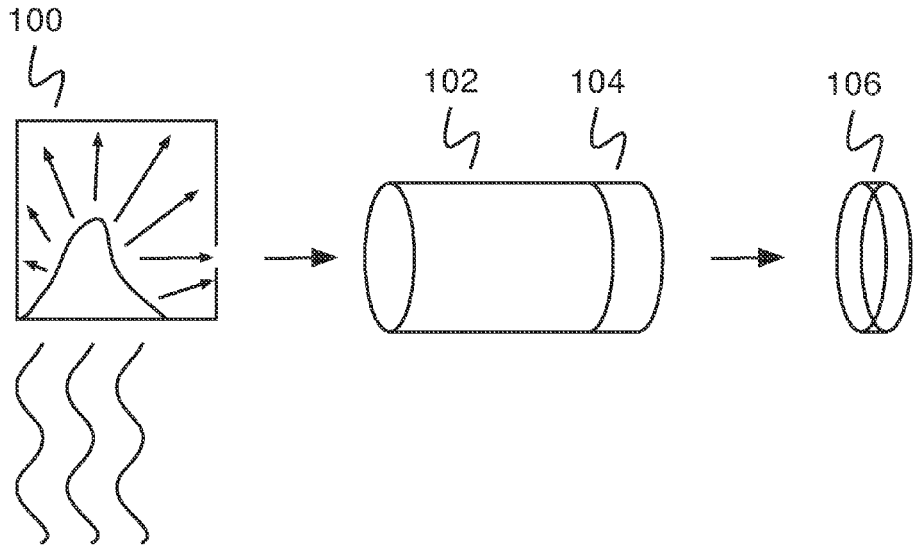
FIG. 1 is a block diagram illustrating an embodiment of a setup for a Zeeman slower.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term processor refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A permanent magnet axial field Zeeman slower is disclosed. The Zeeman slower comprises a set of permanent magnets specifically designed to produce the desired magnetic field shape and a bore for the travel of atoms within the magnetic field. The magnets are small, passive (e.g., require no power or cooling), and vacuum compatible. The Zeeman slower comprises three or more magnets with the axis of magnetization aligned parallel or at an angle to the axis of travel of the atoms moving through the Zeeman slower. The magnets can be placed in a rotationally symmetric pattern in the transverse plane, e.g., at positions of 360°/n, where n is the number of magnets. This approach maximizes the uniformity of the magnetic field in the transverse plane at a given axial position. Alternatively, the magnets can be placed in a rotationally non-symmetric pattern in the transverse plane, i.e., at a variety of angles. This approach allows tailoring the magnetic field shape in the transverse plane at a given axial position. In some embodiments, the Zeeman slower additionally comprises a magnetic shield (e.g., for isolating the magnetic field of the slower) and a transverse cooling apparatus (e.g., for reducing the transverse speed of traveling atoms). In various embodiments, the magnetic shield comprises a material with high magnetic permeability, multiple layers—a mix of high permeability material (e.g., mu metal) with a lower permeability (e.g., soft iron), one or more layers of one or more materials, a nano-technology coating, or any other appropriate shield. In some embodiments, the magnetic shield alters the shape, the field direction, or the magnitude of the Zeeman slower magnetic field inside the bore. In various embodiments, the magnetic shield alters an axial position for the zero-crossings of the magnetic fields, or the magnitude or shape of the associated maxima in the magnetic field amplitude. In some embodiments, the magnetic shield improves the uniformity of the Zeeman slower magnetic field inside the bore. In some embodiments, the one or more tapered magnets are configured to make a magnetic field magnitude change quickly outside the slower (e.g., faster than inverse distance squared). In some embodiments, the magnetic shield comprises of one or more separable pieces.

In some embodiments, the slower comprises a single or multi-layer thermal or radiative shield that thermally isolates the slower. The thermal or radiative shield allows minimizing the separation between the slower and the evaporator which, in turn, enables compact devices or for evaporators emitting poorly collimated beams. In addition, because the slower is close to the evaporator the atomic beam is only allowed to spread minimally before it enters the slower.

In some embodiments, the transverse cooler is tilted in angle relative to the main axis of the slower This approach is useful for some applications (e.g., separating the slowed atomic beam from residual non-slowed atoms; reducing the scattered light that reaches subsequent devices, and allowing the slowing light to pass through the slower without passing through the transverse cooler).

Previously developed permanent magnet Zeeman slowers have utilized a transverse magnetic field for the axial slowing, resulting in lower efficiency. The slower described herein utilizes an axial magnetic field for slowing, resulting in higher efficiency. The axial magnetic field is established using permanent magnets without field lines reversing direction or varying significantly in density as the transverse position increases away from the axis.

In various embodiments, the bore is configured to provide one or more reference features or one or more mounting surfaces for optics used for a transverse cooler. In some embodiments, the slower is mounted in a vacuum chamber. In some embodiments, the bore of the atomic slower is configured to allow a laser beam to enter. For example, along the axis of the atomic beam and/or transverse to the atomic beam. In some embodiments, the bore is configured to provide one or more reference features or one or more mounting surfaces for the one or more tapered permanent magnets. The reference features or surfaces allow for setting the axial and transverse positions and rotational orientations for the magnets. In some embodiments, the bore is configured to provide one or more reference features or one or more mounting surfaces for the magnetic shield or is used by a secondary device to mount or position the magnetic shield. The features or surfaces can comprise edges, the surface or planar or non-planar shapes, or markers. For example, the outer surface of a bore with a circular cross-section can be used to make a magnetic shield with a circular cross-section concentric with the axis of the bore while an edge on the outer surface of the bore can be used to set the axial position of the shield. The reference features or mounting surfaces enable easy and precise assembly or construction of the slower.

FIG. 1 is a block diagram illustrating an embodiment of a setup for a Zeeman slower. In some embodiments, the block diagram of FIG. 1 illustrates an embodiment of a setup for producing a collection of cold atoms (e.g., atoms with thermal energy approaching absolute zero). In various embodiments, a collection of cold atoms is used for experiments on Bose-Einstein condensation, for atomic clocks, for atom interferometers, for spectroscopy, or for any other appropriate purpose. In the example shown, the setup shown in FIG. 1 comprises evaporator 100, Zeeman slower 102 including transverse cooler 104, and atomic trap 106. Evaporator 100 comprises a purified collection of atoms that is heated to produce an atomic vapor. The chamber walls include an outlet that allows the atomic vapor to escape. In some cases, the outlet is a pinhole, an array of tubes, a cylindrical channel, a slit or array of slits, a microchannel plate, or combinations of these shapes. For properly configured outlets, the escaping atoms will travel in nearly the same direction and form an atomic beam whose transverse speed is a fraction of its axial speed (i.e., a collimated atomic beam). Inside the evaporator, and assuming thermal equilibrium between the atomic vapor and the evaporator walls, the distribution of atomic speeds along any given axis is described by a Maxwell-Boltzmann distribution whose temperature is equal to the evaporator temperature and which is proportional to the atomic velocity squared. The probability that an atom with a given speed, u, will encounter the outlet and exit the evaporator increases as u increases. Consequently, the axial speed distribution for the collimated atomic beam is often proportional to the atomic speed cubed. This distribution is called a modified Maxwell-Boltzmann distribution. It is typically centered at speeds of hundreds of meters per second. In order to be caught by a typical atomic trap (e.g., atomic trap 106), atoms must be slowed to tens of meters per second. Atoms are slowed using Zeeman slower 102 and transverse cooler 104.

The atomic beam enters Zeeman slower 102 and atoms are slowed as they travel through the Zeeman slower (e.g., from left to right in FIG. 1). In some embodiments, the Zeeman slower includes thermal or radiative shielding that isolates the slower from the evaporator. In some embodiments, the shielding comprises one or more layers or material (e.g., ceramics, metals, or dielectric reflectors). In various embodiments, the shielding includes insulating screws, washers, or spacers, or any other appropriate items. Atoms are slowed with a laser beam pointing in the opposite direction of travel of the atomic beam (e.g., right to left in FIG. 1). The laser beam is tuned to the resonant frequency of atoms in the beam as they enter, and an externally applied magnetic field modifies the resonant frequency of the atomic beam to stay at the frequency of the laser as the atoms in the beam slow down. Following Zeeman slower 102 is transverse cooler 104. Transverse cooler 104 comprises a laser beam in the transverse direction (e.g., perpendicular to the direction of travel of the atomic beam) for reducing the transverse speed of the atoms traveling in the beam (e.g., increasing the collimation of the beam).

In some embodiments, the methods described are used in a reverse configuration where the magnetic field and the laser beam are used to accelerate the atomic beam rather than slow the atomic beam. To accelerate the atomic beam the laser and atoms travel in the same direction rather than in opposite directions, as used in the slower. The atom accelerator moves the atoms to higher speed and narrows the longitudinal velocity distribution. Faster moving atoms with a narrow velocity distribution, or just narrower velocity distributions can be advantageous for applications such as atomic interferometers gyroscopes, clocks, scientific tests, etc. and some environments such as moving platforms, in space, etc.

Atomic trap 106 comprises an atomic trap that provides additional cooling and spatial confinement of atoms in the atomic beam. In some embodiments, atomic trap 106 comprises a magneto-optical trap. In some embodiments, atomic trap 106 comprises one or several focused or collimated laser beams. In some embodiments, atomic trap 106 provides only spatial confinement (i.e., is a conservative trap). In some embodiments, atomic trap 106 uses magnetic or electric fields to confine the atoms. In some embodiments, atomic trap 106 provides spatial confinement and cooling along one, two, or three dimensions. In some embodiments, atomic trap 106 captures atoms (e.g., reduces their speed to near absolute zero). In some embodiments, atomic trap 106 can only capture atoms if they are already traveling below a certain speed, e.g., 20 m/s. In some embodiments, atomic trap 106 is used to capture atoms for use in further applications. In various embodiments, atomic trap 106 is used to capture atoms for experiments on Bose-Einstein condensation, for atomic clocks, for atom interferometers, for spectroscopy, or for any other appropriate purpose.

Figure 2:
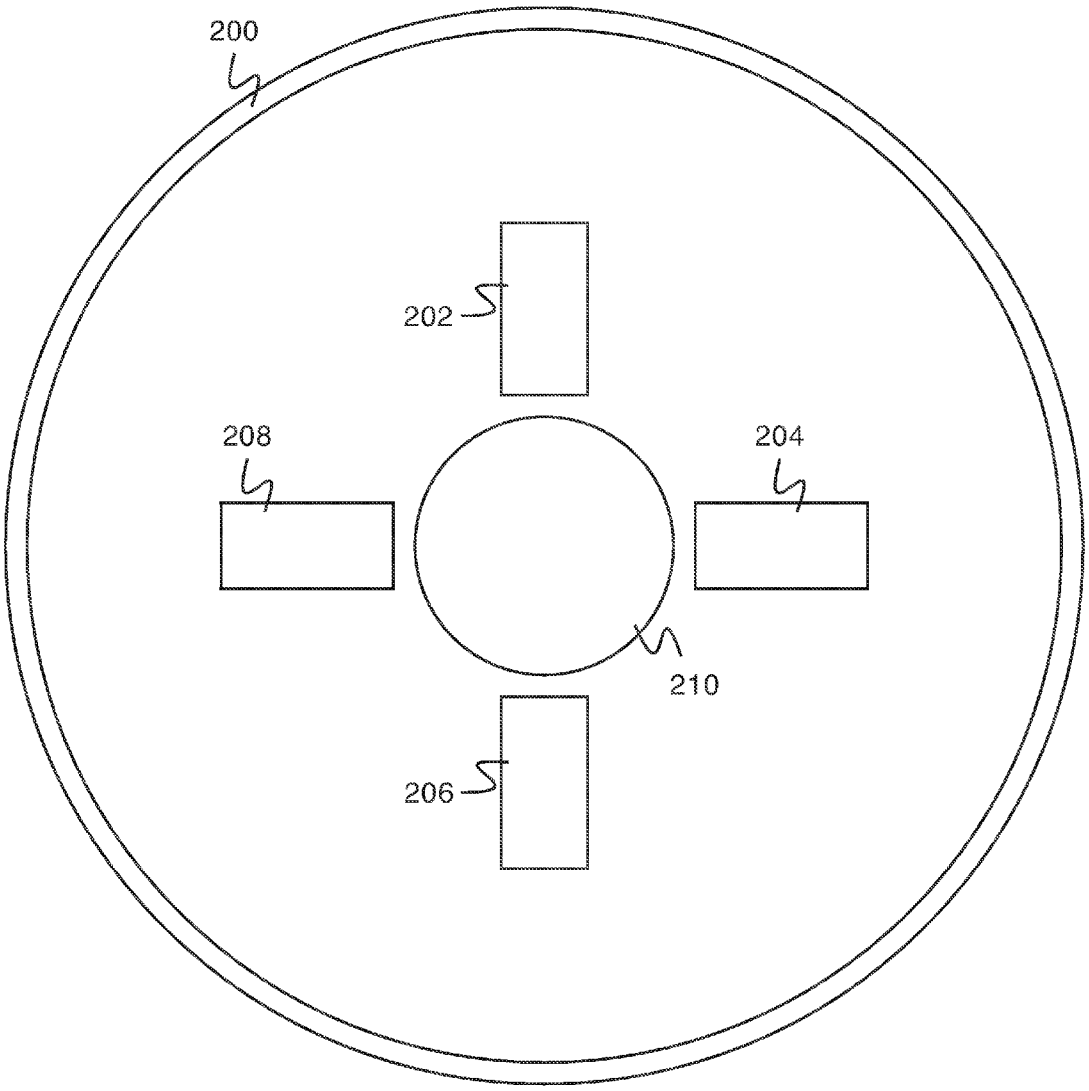
FIG. 2 is a diagram illustrating an embodiment of a transverse cross-section of a Zeeman slower.

FIG. 2 is a diagram illustrating an embodiment of a transverse cross-section of a Zeeman slower. In some embodiments, the diagram of FIG. 2 illustrates a transverse cross-section of Zeeman slower 102 of FIG. 1. In some embodiments, the diagram of FIG. 2 illustrates a transverse cross-section of a permanent magnet axial field Zeeman slower. In the example shown, a transverse cross-section of a Zeeman slower comprises a cross-section of a Zeeman slower in the direction perpendicular to the direction of travel of the atomic beam, e.g., the atomic beam travels in the direction into the page, and the slowing laser beam travels in the direction out of the page. Magnetic shield 200 comprises a magnetic shield for isolating the Zeeman slower, for attenuating the magnetic field outside the slower, for tailoring the shape of the field inside the shield, and for causing the magnetic field amplitude to decrease rapidly at the end of the slower. In some embodiments, magnetic shield 200 has an overall cylindrical shape. In some embodiments, magnetic shield 200 is made of a high permeability metal. In some embodiments, magnetic shield 200 is approximately adjacent to the outer edge of magnet 202, magnet 204, magnet 206, and magnet 208. Magnet 202, magnet 204, magnet 206, and magnet 208 comprise permanent magnets. In some embodiments, the magnetization of magnet 202, magnet 204, magnet 206, and magnet 208 is perpendicular to the faces shown in FIG. 2 (e.g., magnetization lines emerging from the page from the faces shown in FIG. 2) Bore 210 comprises a hole (which could be cylindrical or other shape) that allows the atomic beam to pass in the region between the magnets. In some embodiments, magnet 202, magnet 204, magnet 206, and magnet 208 are mounted directly on bore 210. In some embodiments, magnet 202, magnet 204, magnet 206, and magnet 208 are mounted externally from bore 210. In some embodiments, the assembly of FIG. 2 is mounted in a vacuum chamber.

Figure 3:
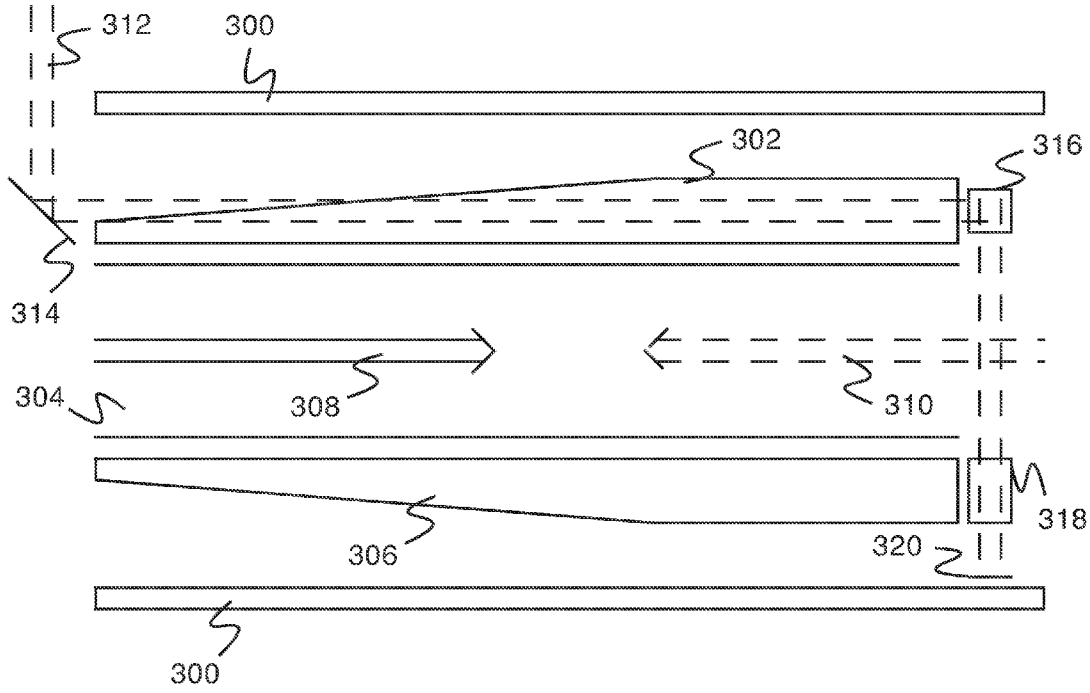
FIG. 3 is a diagram illustrating an embodiment of an axial cross-section of a Zeeman slower with transverse cooling.
Figure 6:
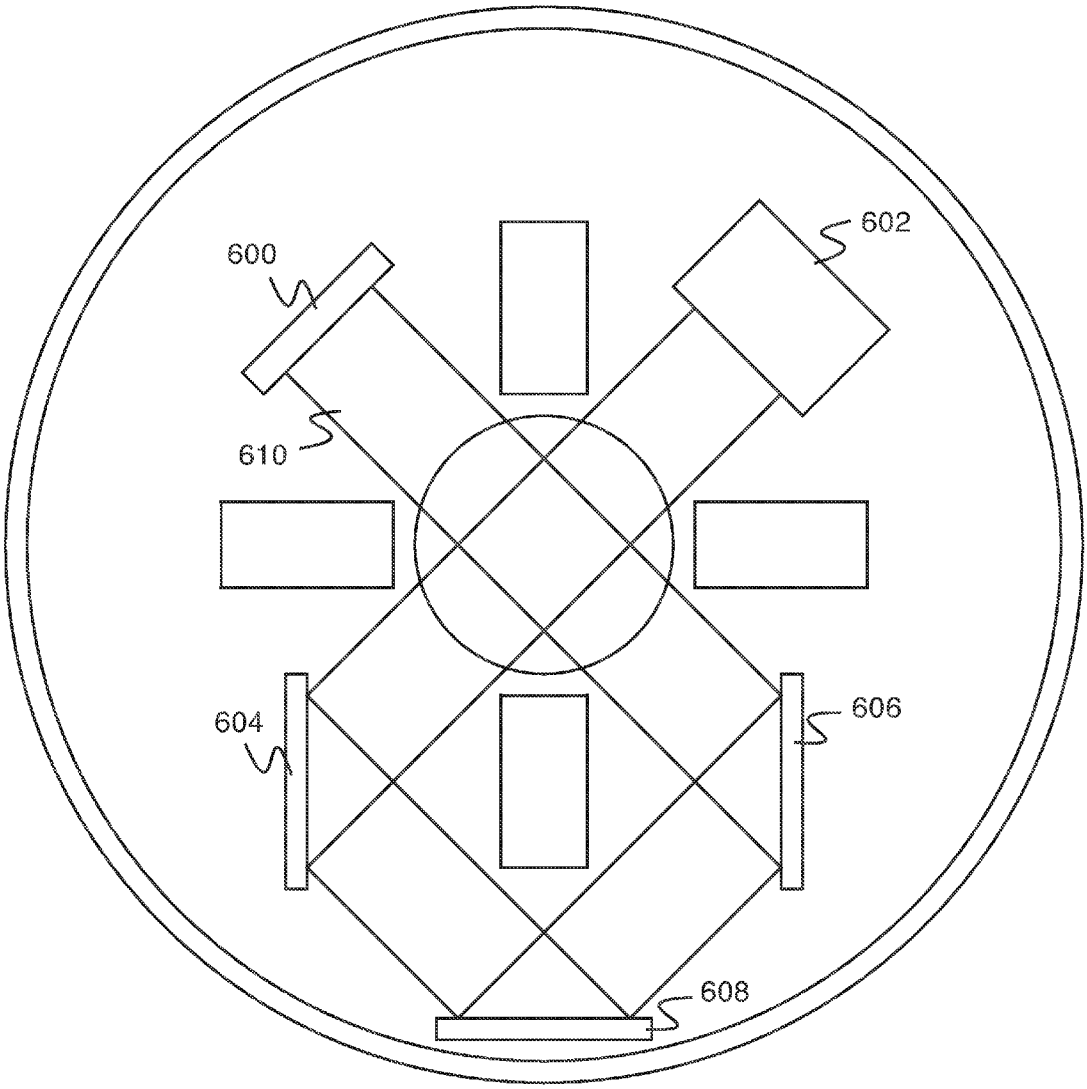
FIG. 6 is a diagram illustrating an embodiment of a cross-sectional view of a transverse cooler for a Zeeman slower.

FIG. 3 is a diagram illustrating an embodiment of an axial cross-section of a Zeeman slower with transverse cooling. In some embodiments, the diagram of FIG. 3 illustrates an axial cross-section of Zeeman slower 102 of FIG. 1 and transverse cooler 104 of FIG. 1. In some embodiments, the diagram of FIG. 3 illustrates an axial cross-section of a permanent magnet axial field Zeeman slower. In the example shown, an axial cross-section of a Zeeman slower comprises a cross-section of a Zeeman slower in the direction parallel to the direction of travel of the atomic beam, e.g., atomic beam 308 travels from left to right in the drawing and slowing laser beam 310 travels from right to left in the drawing. In the example shown, magnetic shield 300 (shown at both the upper and lower parts of the drawing) comprises a magnetic shield for isolating the Zeeman slower and for causing the magnetic field to fall off quickly away from the slower ends (e.g., by including end caps at the ends of the bore and beyond the ends of the magnets). Magnet 302 and magnet 306 comprise permanent magnets. In the example shown, the Zeeman slower comprises four magnets, two of which are not visible in the cross-section. In various embodiments, the Zeeman slower comprises 3, 4, 5, 6, 8, 12, or any other appropriate number of magnets. The magnetization of magnet 302 and magnet 306 is along the long direction of the magnets and perpendicular to the left and right end faces, connected by field lines curving back and running parallel to the axis of travel of the atomic beam. Bore 304 comprises a bore allowing the atomic beam to pass down the central axis between the magnets. In the example shown, atomic beam 308 comprises an atomic beam traveling down the length of the Zeeman slower and being slowed by laser beam 310. Bore 304 is configured to allow laser beam 310 to enter. Laser beam 310 is tuned to resonate with atoms in atomic beam 308 as they enter the Zeeman slower (e.g., on the left side). In some embodiments, laser beam 310 is polarized. In some embodiments, laser beam 310 has sigma minus polarization. In some embodiments, laser beam 310 has sigma plus polarization. The magnetic field generated by magnet 302 and magnet 306 (and by the other magnets not shown) modifies the resonant frequency of the atomic beam (e.g., by the Zeeman effect) such that the laser light stays resonant with the atomic beam as the atoms travel across the slower and slow down. In the example shown, magnet 302 and magnet 306 are each tapered in order to achieve the desired magnetic field. In some embodiments, magnet 302 and magnet 306 each comprise multiple tapers. In various embodiments, each magnet (e.g., magnet 302 or magnet 306) is shaped or tapered to achieve a desired magnetic field along bore 304 of the slower, or any other appropriate shaping. The pole faces for the magnets are external to the bore. The individual magnets may be segmented into several axial pieces that are pressed together or separated. In some embodiments, magnet 302 and magnet 306 are made from Alnico, Samarium Cobalt, Ferrite ceramics, Neodymium, or flexible sheets or strips. In some embodiments, the magnets are pressed, molded, bonded, or sintered. In some embodiments, the magnets are ground to shape before or after orienting their magnetization. In some embodiments, the pole faces of the magnets are external to the bore. In various embodiments, the one or more tapered permanent magnets are ground or otherwise formed to shape before or after the magnetization is oriented. In some embodiments, a magnet tapered magnet comprises several magnets placed together that fill or approximately fill a tapered volume. By approximating a tapered magnet, the several magnets placed together achieve the desired axial magnetic field profile. Transverse cooling laser 312 of transverse cooler comprises a laser for reducing the transverse speed of the atomic beam. In one specific embodiment, shown as an example, the transverse cooling laser 312 enters the Zeeman slower at the atomic beam entrance side, is reflected by mirror 314, travels the length of the slower, and is reflected into a set of optics, including mirrors 316, mirrors 318, and mirror 320. In the example shown, mirrors 316 comprise two mirrors and mirrors 318 comprise two mirrors. The five mirrors comprising mirrors 316, mirrors 318, and mirror 320 reflect cooling laser 312 into a loop passing through the exit of atomic beam 308 from bore 304. An axial view of an embodiment of transverse cooling is shown in FIG. 6. When atoms comprising atomic beam 308 pass through transverse cooling laser 312, their average transverse speed (e.g., speed up, down, into, or out of the page as drawn in FIG. 3) is reduced, improving the collimation of the beam. The design as shown couples the transverse cooler as closely as possible to the Zeeman slower, reducing transverse speed before atomic beam 308 has had a chance to diverge. In some embodiments, the assembly of FIG. 3 is mounted in a vacuum chamber. In some embodiments, the transverse cooler cools the atoms at or near the point of exit of the slower so that the atoms have near zero transverse velocity as they exit the slower. In some embodiments, the axis of the transverse cooling region is tilted relative to the axis of the main slowing region to both transverse cool and deflect the slow atoms relative to the central axis of the Zeeman slower. A deflected beam of slow atoms can be advantageous for some applications (e.g., separating the slowed atomic beam from residual non-slowed atoms; reducing the scattered light that reaches subsequent devices, and allowing the slowing light to pass through the slower without passing through the transverse cooler, etc.). In some embodiments, the transverse cooling and deflection region comprise one or several magneto-optical traps that transversely compress, cool, or deflect the atomic beam along one or several axes. In various embodiments, the transverse cooling and deflection region comprises one or more segmented sections each of whose central axis is oriented relative to the axis of the bore in one of the following ways: collinear, tilted, offset, or a combination of tilted and offset, the same as other central axes, different from other central axes, or any other appropriate combination. In various embodiments, the segmented regions use cooling light with equal or different dimensions and equal or different intensities and magnetic fields with equal or different magnitudes, spatial extents, and gradients, or any other appropriate combination. In some embodiments, the transverse cooler is placed at a point of exit of the slower or a point where a deceleration induced by the slower drops to a fraction of its maximum value. In some embodiments, the optics for the transverse cooler are housed inside the magnetic shield. In some embodiments, the transverse cooler includes optics in a racetrack geometry. In some embodiments, the transverse cooler includes routing light around the one or more tapered magnets.

Figure 4:
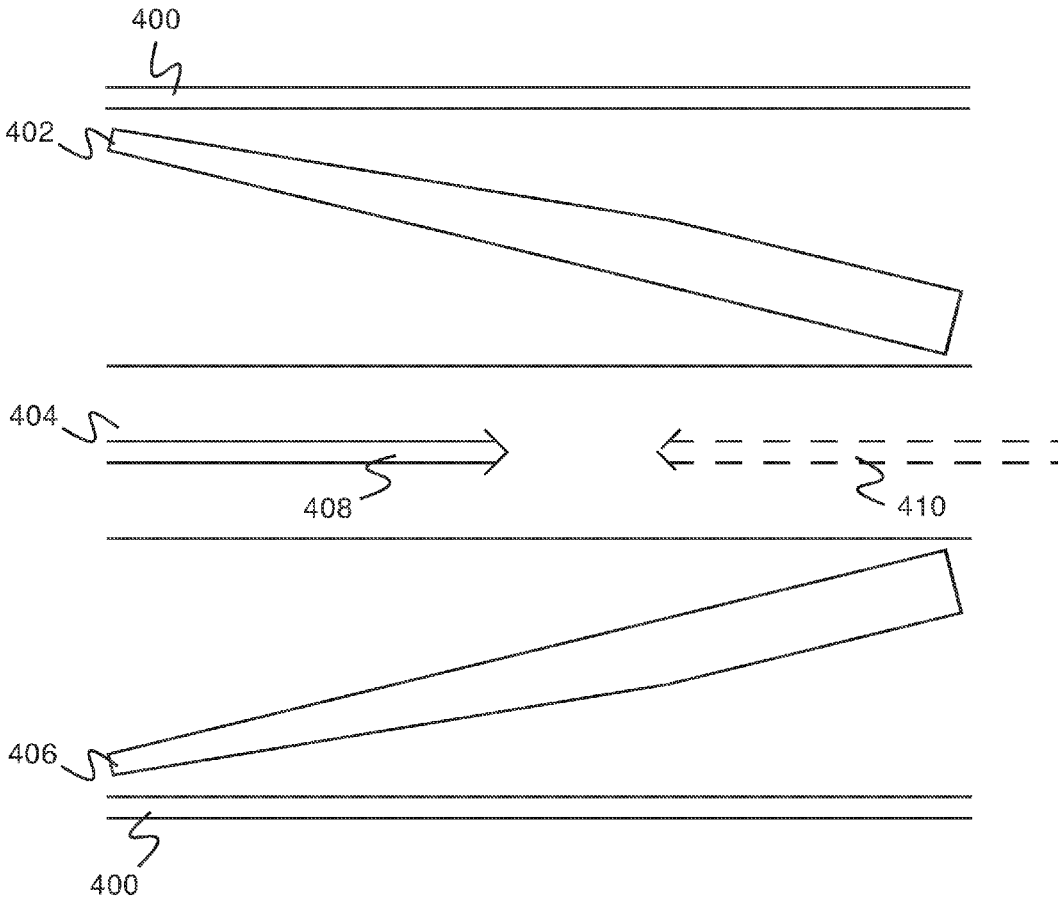
FIG. 4 is a diagram illustrating an embodiment of an axial cross-section of an alternative design for a Zeeman slower.

FIG. 4 is a diagram illustrating an embodiment of an axial cross-section of an alternative design for a Zeeman slower. In some embodiments, the diagram of FIG. 4 illustrates an axial cross-section of an alternative design of Zeeman slower 102 of FIG. 1. In the example shown, an axial cross-section of a Zeeman slower comprises a cross-section of a Zeeman slower in the direction parallel to the direction of travel of the atomic beam, e.g., the atomic beam travels from left to right in the drawing and the slowing laser beam travels from right to left in the drawing. The diagram of FIG. 4 does not show transverse cooling (e.g., transverse cooling laser 312 of FIG. 3 and mirrors 316, mirrors 318, and mirror 320 of FIG. 3) but transverse cooling may be included in the embodiment illustrated in FIG. 4.

In the example shown, magnetic shield 400 (shown in cross-section at both the upper and lower parts of the drawing) comprises a magnetic shield for isolating the Zeeman slower from external magnetic fields and for causing the magnetic field to fall quickly after the slower ends. Magnet 402 and magnet 406 comprise permanent magnets. In the example shown, the Zeeman slower comprises four magnets, two of which are not visible in the cross-section. In various embodiments, the Zeeman slower comprises 3, 4, 5, 6, 8, 12, or any other appropriate number of magnets. Bore 404 comprises a bore for confining an atomic beam. In the example shown, atomic beam 408 comprises an atomic beam traveling down the length of the Zeeman slower and being slowed by laser 410.

In the example shown, magnet 402 and magnet 406 are positioned with their long axes angled toward atomic beam 408 as the beam progresses from left to right through the slower. In some embodiments, magnet 402 and magnet 406 are positioned with their long axes angled away from atomic beam 408 as the beam propagates from left to right through the slower. In some embodiments, magnet 402 and magnet 406 are mounted on shaped supports mounted on bore 404, holding them in the positions shown. In some embodiments, magnet 402 and magnet 406 are mounted on external supports holding them in the positions shown. In the example shown, both the shape of the magnets and the angle that the magnets are held are tuned in order to produce the desired magnetic field shape. In some embodiments, the angle comprises an angle of a magnet with respect to the axis of the bore of a Zeeman slower. In some embodiments, magnet 402 and magnet 406 are rotated about their long axis.

Figure 5A:
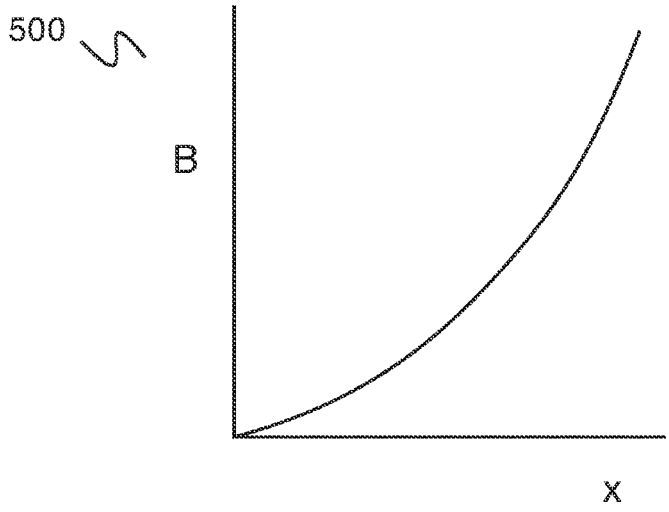
FIG. 5A is a diagram illustrating an embodiment of a graph of ideal magnetic field magnitude versus position for a sigma minus polarized Zeeman slower.

FIG. 5A is a diagram illustrating an embodiment of a graph of ideal magnetic field magnitude versus position for a sigma minus polarized Zeeman slower. In some embodiments, graph 500 illustrates the desired magnetization along the axis of a permanent magnet axial field Zeeman slower (e.g., the Zeeman slower of FIG. 3). In the example shown, the magnetic field starts at zero (e.g., at the position where the atomic beam enters the slower) and increases at a rate greater than linear. In some embodiments, the magnetic field magnitude increases at a linear rate. In some embodiments, when the Zeeman slower ends (e.g., at the right side of the graph), it is desirable for the magnetic field to fall to zero as quickly as possible.

Figure 5B:
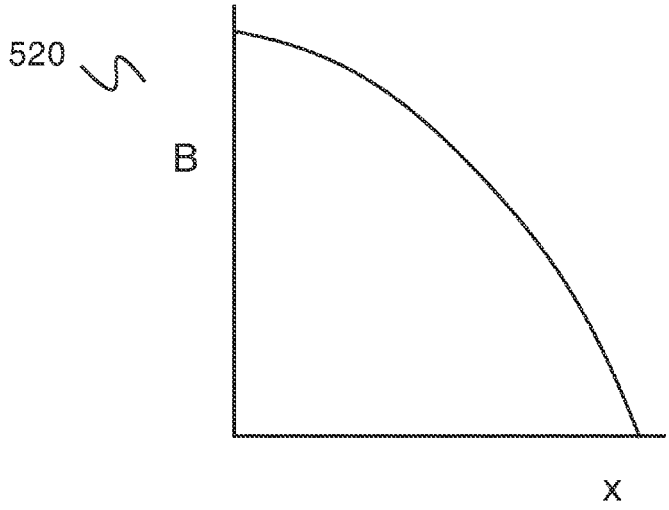
FIG. 5B is a diagram illustrating an embodiment of a graph of ideal magnetization versus position for a sigma plus polarized Zeeman slower.

FIG. 5B is a diagram illustrating an embodiment of a graph of ideal magnetization versus position for a sigma plus polarized Zeeman slower. In some embodiments, graph 520 illustrates the desired magnetization along the axis of a permanent magnet axial field Zeeman slower. In the example shown, the magnetic field equals that of graph 500 of FIG. 5A subtracted from a constant magnetization value, e.g., the magnetic field starts out at the constant magnetization value (e.g., at the position where the atomic beam enters the slower) and drops at a rate greater than linear, ending at zero (e.g., at the position where the atomic beam exits the slower). In some embodiments, the magnetic field magnitude decreases at a linear rate. In some embodiments, before the Zeeman slower starts (e.g., at the left side of the graph), it is desirable for the magnetic field to fall to zero as quickly as possible.

Figure 5C:
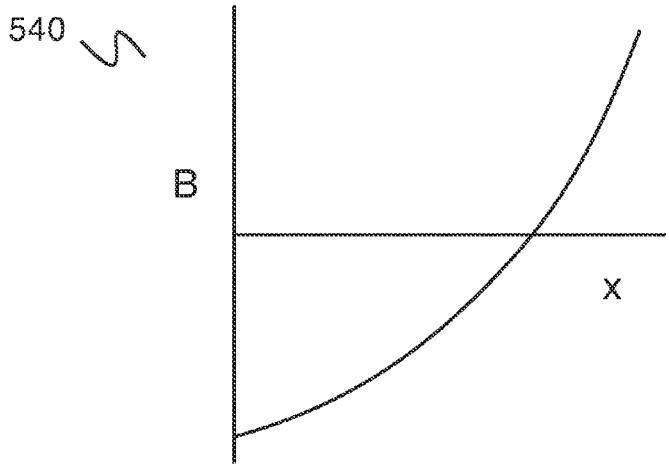
FIG. 5C is a diagram illustrating an embodiment of a graph of ideal magnetization versus position for a spin flip Zeeman slower.

FIG. 5C is a diagram illustrating an embodiment of a graph of ideal magnetization versus position for a spin flip Zeeman slower. In some embodiments, graph 540 illustrates the desired magnetization along the axis of a permanent magnet axial field Zeeman slower. In the example shown, the magnetic field equals that of graph 500 of FIG. 5A with a constant magnetization value subtracted, e.g., the magnetic field starts out at a negative value (e.g., at the position where the atomic beam enters the slower) and increases at a rate greater than linear, passing through zero and ending at a positive value (e.g., at the position where the atomic beam exits the slower). In some embodiments, the magnetic field magnitude increases at a linear rate. In some embodiments, before the Zeeman slower starts and after the Zeeman slower ends (e.g., at either side of the graph), it is desirable for the magnetic field to fall to zero as quickly as possible.

FIG. 6 is a diagram illustrating an embodiment of a cross-sectional view of a transverse cooler for a Zeeman slower. In some embodiments, the diagram of FIG. 6 illustrates a transverse cross-section of transverse cooler 104 of FIG. 1. In some embodiments, the diagram of FIG. 6 illustrates a transverse cross-section through the Zeeman slower with transverse cooling illustrated in the diagram of FIG. 3, through mirrors 316 of FIG. 3, mirrors 318 of FIG. 3, and mirror 320 of FIG. 3. In the example shown, the transverse cooler includes mirror 600, mirror 602, mirror 604, mirror 606, mirror 608, and cooling laser light 610. The mirrors and laser are shown superimposed on a set of magnets and a bore (e.g., magnet 202, magnet 204, magnet 206, magnet 208, and bore 210 of FIG. 2) for reference. Cooling laser light 610 is projected axially (e.g., in the direction out of the page as drawn in FIG. 6) and reflected into the transverse plane by mirror 602. Mirror 604, mirror 608, and mirror 606 cause an overall 90 degree rotation in the direction of propagation of laser 610, which is then reflected back by mirror 600. There is thus laser light traveling in four orthogonal directions transverse to the bore, slowing transverse motion in all directions. In some embodiments, the configuration of mirror 600, mirror 602, mirror 604, mirror 606, and mirror 608 is sometimes described as a racetrack geometry.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An atomic slower, comprising:

a bore; and one or more tapered permanent magnets configured to produce an axial magnetic field along an axis of the bore, wherein the axial magnetic field is non-linear.

2. The slower of claim 1, wherein a magnet of the one or more tapered permanent magnets comprises several magnets with arbitrary shape that fill a tapered volume.

3. The slower of claim 1, further comprising a magnetic shield surrounding the one or more permanent magnets.

4. The slower of claim 3, wherein the magnetic shield comprises a material with high magnetic permeability.

5. The slower of claim 3, wherein the magnetic shield comprises one or more layers of one or more materials.

6. The slower of claim 3, wherein the magnetic shield comprises a nanotechnology coating.

7. The slower of claim 3, wherein the magnetic shield includes end-caps at ends of the bore.

8. The slower of claim 3, wherein a magnetic shield alters a shape, a field direction, or a magnitude of the magnetic field inside the bore.

9. The slower of claim 3, wherein the magnetic shield alters an axial position for zero-crossings of a magnetic field along the axis, or a magnitude or a shape of an associated maxima in a magnetic field amplitude.

10. The slower of claim 3, wherein the magnetic shield improves uniformity of the axial magnetic field inside the bore.

11. The slower of claim 3, wherein the one or more tapered permanent magnets are configured to make a magnetic field magnitude change faster than inverse distance squared outside the slower.

12. The slower of claim 3, wherein the magnetic shield comprises one or more separable pieces.

13. The slower of claim 3 wherein the bore is configured to provide one or more reference features or one or more mounting surfaces for the magnetic shield or is used by a secondary device to mount or position the magnetic shield.

14. The slower of claim 1, further comprising a single or multi-layer thermal or radiative shield that thermally isolates the slower.

15. The slower of claim 1, further comprising a transverse cooler.

16. The slower of claim 15, wherein the transverse cooler is tilted in angle relative to the axis.

17. The slower of claim 15, wherein the transverse cooler comprises one or several magneto-optical traps that transversely compress, cool, or deflect an atomic beam along one or several axes.

18. The slower of claim 15 wherein the transverse cooler comprises one or more segmented sections each of whose central axis is oriented relative to the axis of the bore in one of the following ways: collinear, tilted, offset, or a combination of tilted and offset.

19. The slower of claim 15, wherein the transverse cooler is placed at a point of exit of the atomic slower or a point where a deceleration induced by the atomic slower drops to a fraction of a maximum value.

20. The slower of claim 15, wherein optics for the transverse cooler are housed inside a magnetic shield.

21. The slower of claim 15, wherein the transverse cooler includes optics in a racetrack geometry.

22. The slower of claim 15, wherein the transverse cooling includes routing light around the one or more tapered permanent magnets.

23. The slower of claim 1, wherein the bore is configured to provide one or more reference features or one or more mounting surfaces for optics used for a transverse cooler.

24. The slower of claim 1, wherein the axial magnetic field generated by the one or more tapered permanent magnets modifies a resonant frequency of an atomic beam to slow down atoms of the atomic beam traveling along the bore.

25. The slower of claim 1, wherein the bore is configured to provide one or more reference features or one or more mounting surfaces for the one or more tapered permanent magnets.

26. The slower of claim 1, wherein the bore is configured to allow a laser beam to enter.

27. The slower of claim 26, wherein the laser beam is polarized.

28. The slower of claim 26, wherein the axial magnetic field is configured such that the laser beam is sigma minus polarized.

29. The slower of claim 26, wherein the axial magnetic field is configured such that the laser beam is sigma plus polarized.

30. The slower of claim 1, wherein one of the one or more tapered permanent magnets are held at an angle with respect to the axis of the bore.

31. The slower of claim 1, wherein each of the one or more tapered permanent magnets comprise a magnet with multiple tapers.

32. The slower of claim 1, wherein each of the one or more tapered permanent magnets is segmented.

33. The slower of claim 1, wherein the pole faces for the one or more tapered permanent magnets are external to the bore.

34. The slower of claim 1, wherein the one or more tapered permanent magnets comprise four permanent magnets.

35. The slower of claim 1, wherein the one or more tapered permanent magnets are placed at angular orientations of 360°/n around the bore, where n is the number of permanent magnets.

36. The slower of claim 1, wherein the one or more tapered permanent magnets are made from Alnico, Samarium Cobalt, Ferrite ceramics, Neodymium, or flexible sheets or strips.

37. The slower of claim 1, wherein one or more tapered permanent magnets are ground or otherwise formed to shape before or after the magnetization is oriented.

* * * * *